United States Patent [19]

Consaul

[11] 4,019,658

[45] Apr. 26, 1977

[54] COMBINATION SHOWER HEAD AND TOILETRIES MIXING AND DISPENSING APPARATUS

[76] Inventor: Kenneth E. Consaul, 3100 Plaza Drive, Penthouse I-12, Santa Ana, Calif. 92704

[22] Filed: July 24, 1975

[21] Appl. No.: 599,007

[52] U.S. Cl. ..... 222/144.5; 239/305

[51] Int. Cl.[2] ..... B67D 5/54

[58] Field of Search ..... 239/305, 310; 222/144.5, 190, 181

[56] References Cited

UNITED STATES PATENTS

| | | | |
|---|---|---|---|
| 2,765,959 | 10/1956 | Elliott | 222/181 |
| 2,781,162 | 2/1957 | Soffa et al. | 229/68 |
| 3,007,613 | 11/1961 | Tygard | 222/394 |
| 3,130,873 | 4/1964 | Klutz, Jr. | 222/131 |
| 3,612,355 | 10/1971 | Stucky | 222/144.5 X |
| 3,653,554 | 4/1972 | Turben | 239/305 X |
| 3,718,234 | 2/1973 | Bagguley | 222/144.5 X |
| 3,917,172 | 11/1975 | O'Hare | 239/305 |

*Primary Examiner*—Stanley H. Tollberg
*Assistant Examiner*—Norman L. Stack, Jr.
*Attorney, Agent, or Firm*—Herzig & Walsh, Inc.

[57] ABSTRACT

An integrated unit associated with the shower head adapted for mounting in a shower stall. The unit contains conventional aerosol cans or containers for fluids such as soap and/or shampoo and the like. The aerosol cans are positioned to dispense into cavities, there being channels controlled by valves, providing communication between these channels, and a tube or pipe leading to the shower head for mixing the fluid controllably with the shower water. Associated with the cavities are manually actuatable plungers which are operable to cause dispensing of fluids from the cavities. Manually actuatable means can be provided for actuating the aerosol can valves to dispense.

5 Claims, 7 Drawing Figures

COMBINATION SHOWER HEAD AND TOILETRIES MIXING AND DISPENSING APPARATUS

SUMMARY OF THE INVENTION

1. Field of the Invention

The field of the invention is that of apparatus for dispensing toiletries such as, for example, soap and shampoo and/or the like and mixing such toiletries with shower water. This is the type of unit wherein commercial aerosol cans containing the toiletries are utilized and are provided within a housing or cabinet with means for mixing the toiletries with the shower water and additionally means for manually dispensing individual toiletries if desired.

2. Description of the Prior Art

It has been known in the prior art to provide an apparatus wherein aerosol cans containing toiletries or shower additives are mounted in association with the shower head and with means for mixing the toiletries or additives with the shower water and for manually dispensing the toiletries. Known prior art patents include U.S. Pat. Nos. 2,609,232; 3,486,695; and 3,612,355. The prior art has left room for improvement in the area of the actuation of the valves of the aerosol cans for dispensing the additives or toiletries. Also there has been room for improvement in the particular construction of the apparatus with respect to the means for causing the dispensed toiletries to mix with the shower water and to be readily manually dispensable. The herein invention provides unobvious improvements in these areas.

In preferred forms of the invention, the apparatus takes the form of a unit having a housing mountable on a shower wall. The unit includes a base part which carries the shower head which is connected by a pipe or tube to the shower water supply. The base part of the unit embodies a construction wherein the aerosol cans are held in an upright inverted position with cavities provided for the cans to discharge into. Channels are provided for communication between these cavities and the pipe leading to the shower head for mixing the toiletries with the shower water. Additionally, manually actuatable plunger valves are provided for manually dispensing the toiletries or additives from the cavities. Manual actuators can be provided for manually actuating the stems of the aerosol cans to operate the discharge valves for dispensing.

In the light of the foregoing, the primary object of the invention is to provide an improved and simplified apparatus constructed as a unit for holding aerosol cans containing toiletries and providing for mixing of the toiletries with the shower water and manual dispensing of the toiletries.

A further object is to provide such an apparatus wherein the unit embodies a base part having cavities into which the aerosol cans discharge with channels between these cavities and the pipe leading to the shower head for mixing.

A further object is to provide an apparatus as in the foregoing object with control valves in the channels leading from the cavities to the pipe leading to the shower head and with manually actuatable plunger valves for dispensing from the cavities.

Further objects and additional advantages of the invention will become apparent from the following detailed description and annexed drawings.

DESCRIPTION OF THE PREFERRED EMBODIMENTS

Figure 1:
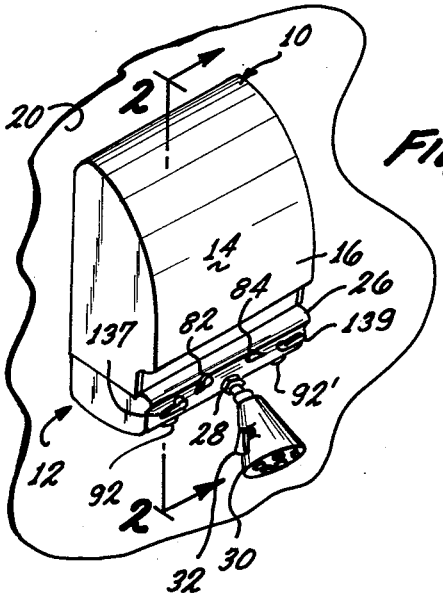
FIG. 1. is a pictorial view of a preferred form of the invention.

Referring to FIGS. 1–4 of the drawings, numeral 10 designates a preferred form of the apparatus. In this form of the apparatus, there is a bottom section 12 which may be a molding or casting having a flat rear wall 13.

Numeral 14 designates a housing or cover which may be made of suitable material such as metal or plastic having a flat rear wall 15 and a contoured front wall 16. The lower edges of this part are secured to the bottom section 12 as shown.

The entire unit may be secured to a shower wall 20 as shown. The typical plumbing connections may be present for supply of hot and cold water. The typical plumbing connection is shown at 22.

Figure 2:
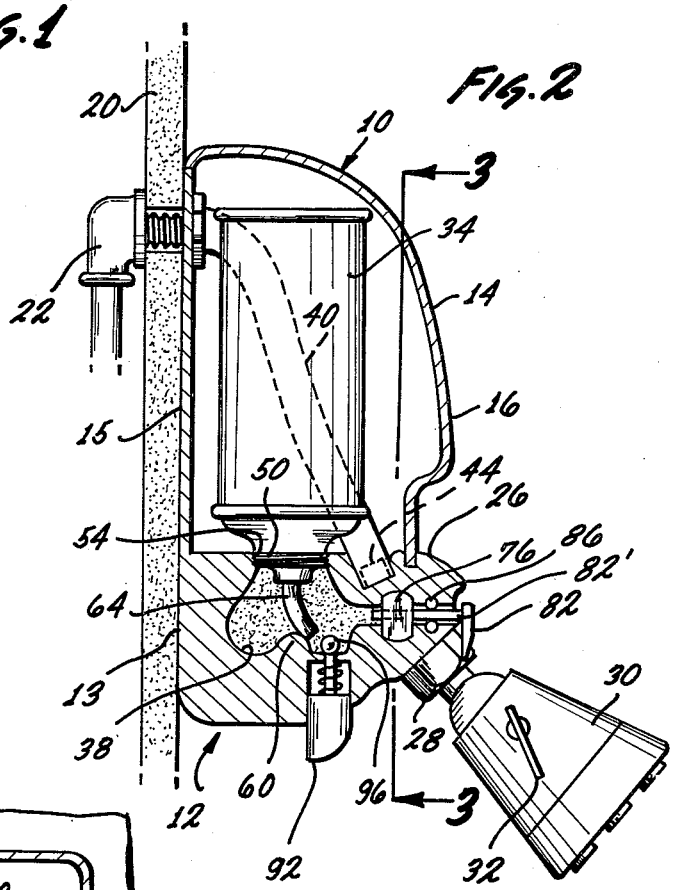
FIG. 2 is a sectional view taken along the line 2—2 of FIG. 1.
Figure 3:
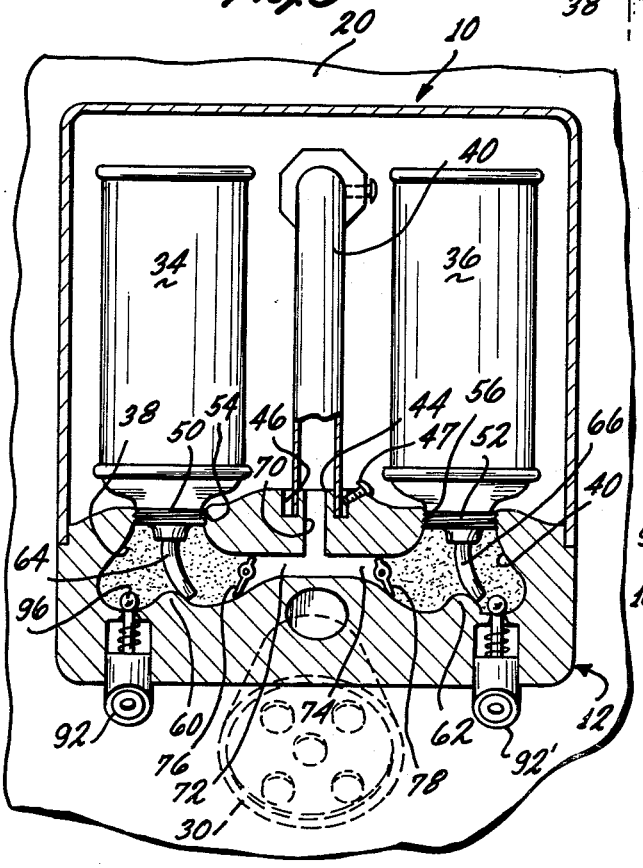
FIG. 3 is a sectional view taken along the line 3—3 of FIG. 2.

The bottom section 12 has a configuration as may be observed from the cross-sectional views of FIGS. 2 and 3. The front part of the section 12 is contoured as illustrated at 26 and at the center of this part is carried a fitting 28 which is secured to conventional shower head 30 with a control handle 32. Within the part 14 of the unit are carried a pair of conventional aerosol cans 34 and 36 which are in an upright position as shown. Within the section 12 are cavities as designated at 38 and 40. Between the aerosol cans 34 and 36 is a pipe or tube 40 which passes through the rear wall 15 and connects by a plumbing fitting to a previously described fitting 22. The lower end of pipe 40 fits over a nipple 44 extending upwardly from the section 12 within a concentric recess 46, being held by a set screw 47.

The aerosol cans 34 and 36 preferably are of the type having threaded necks 50 and 52. These necks are threaded into threaded openings 54 and 56 formed in the upper part of the section 12 above the cavities 38 and 40. At the bottom of the cavity 38 is a raised hump 60 and at the bottom of the cavity 40 is a raised hump 62. The aerosol cans 34 and 36 are provided with flexible dispensing stems as provided at 64 and 66. When the aerosol cans are in position, the stems 64 and 66 come into engagement with the humps 60 and 62 so that the stems are held in a position as shown, being bent away from the center lines of the aerosol cans, which is the dispensing position so that the cans normally dispense into and fill the cavities 38 and 40.

Numeral 70 designates a channel which is in the nipple part 44 communicating with the pipe 40 and this channel communicates with the fitting 28 and the shower head 30. Numerals 72 and 74 designate transverse channels providing communication between the cavities 38 and 40 and the channel 70. Provided in these channels are control valves 76 and 78 which are actuatable by manual actuating handles as designated at 82 and 84. The handle 82 may be seen in FIG. 2, it being carried on a stem 82' in a bore and being sealed by an O-ring 86.

External manual controls may alternatively be provided for controlling the actuating of the dispensing tubes of the aerosol cans. These controls may be actuated by operating handles as well as will be described in connection with a further embodiment. FIG. 1 shows these additional manual operating handles.

Figure 4:
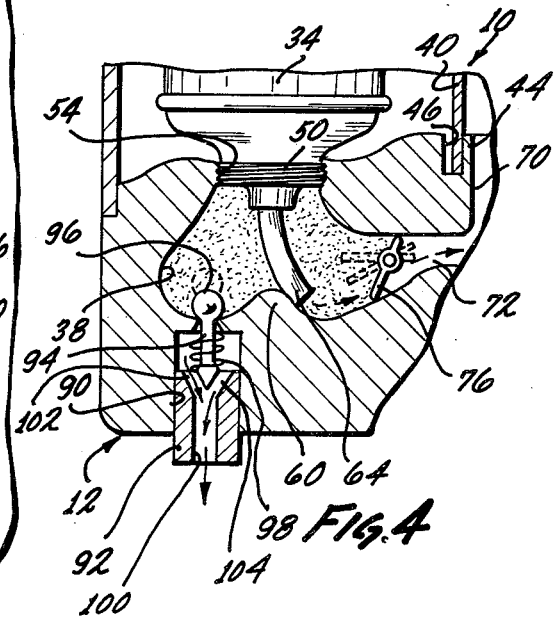
FIG. 4 is an enlarged view of a sectional part of FIG. 3.

Referring to FIG. 4 provided in the bottom of the section 12 is a bore 90 having a valve plunger 92. The plunger 92 has a stem 94 extending through a valve port in the bottom of the cavity 38, there being a ball 96 on the end of the stem. Numeral 98 designates a coil spring that normally biases the plunger 92 in an outward direction. The plunger 92 has a bore 100 in it connecting to a pair of slant bores 102 and 104 communicating with the bore 90. The plunger 92 is manually operable and can be pushed in with the palm of the hand to move the ball 96 away from the valve seat port to allow the toiletries, such as soap or shampoo, to be dispensed from the cavity 38 and this material passing through the valve port and into the bore 90, and then through the channels 100, 102 and 104 in the plunger 92 and outwardly. A second plunger of similar construction is designated at 92' communicating with the cavity 40. The additive or toiletry can be dispensed from the cavity as well.

From the foregoing, the operation will be understood by those skilled in the art. As pointed out, the aerosol cans 34 and 36 may contain shower water additives or toiletries or otherwise. This material normally dispenses into the cavities 38 and 40 wherein it is available to be mixed with the shower water passing through channels 72 and 74 so as to mix with the water coming through channel 70 for delivery to the shower head. Handles 82 and 84 provide control of the channels 72 and 74 to control the flow of the additive or toiletry as desired. Either additive can be dispensed from the cavities 38 or 40 and by manual actuation of the plungers 92 and 92'.

Figure 5:
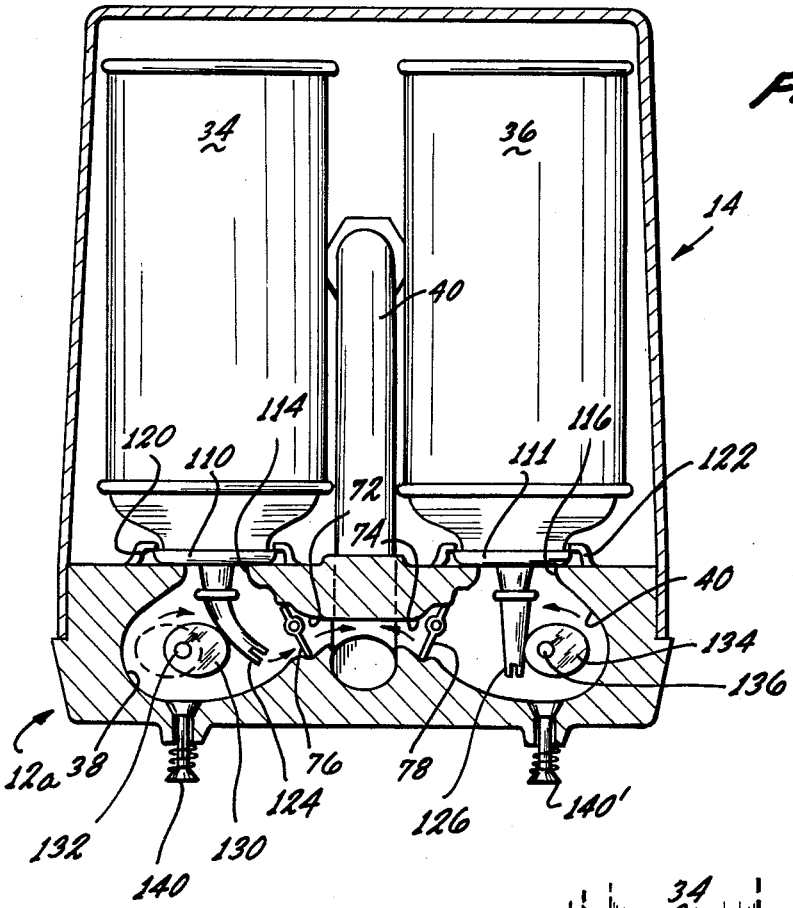
FIG. 5 is a sectional view of a modified form of the invention.

In FIG. 5 there is shown a modified form of the invention wherein the aerosol cans 34 and 36 are provided with cap parts 110 and 111 which seat on section **12*a* over openings 114 and 116 communicating with the cavities 38 and 40. The aerosol cans are removably held in position by the holding rings 120 and 122. The can 34 has a dispensing stem 124 and the can 36 has a dispensing stem 126. The stem 124 is actuatable by an oval shaped cam 130 which is on stem 132 and can be actuated by a manual operating handle like those shown in FIG. 1. The stem 126 can be actuated by an oval cam 134 on a stem 136 which also can be actuated by a manual handle like those shown at 137 and 139 in FIG. 1. Numerals 140 and 140' designate manually actuatable dispensing plungers which are shown schematically but which may be like that shown in FIG. 4.**

From the foregoing it can be seen that the embodiment of FIG. 5 operates like that of the previous embodiment with the additional capability that the dispensing valves of the aerosol cans 34 and 36 are manually controllable by handles that actuate the cams 130 and 134.

Figure 6:
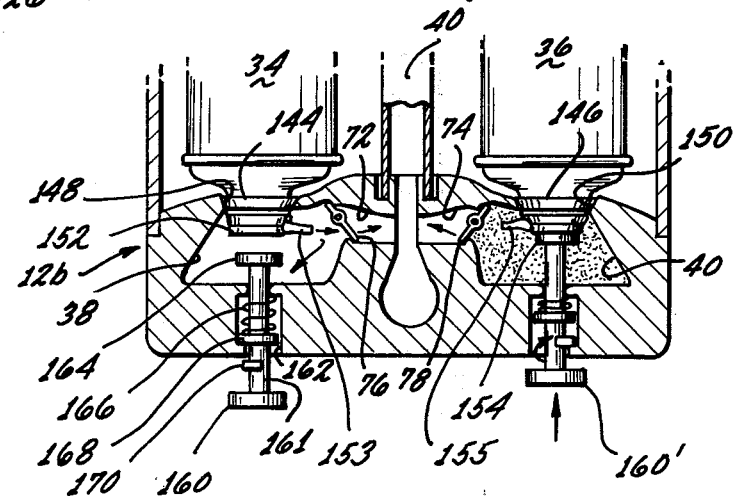
FIG. 6 is a partial sectional view of another modified form of the invention.

FIG. 6 shows another modified form of the invention utilizing aerosol cans 34 and 36 which have slightly different dispensing attachments. The cans are held in a similar position with neck parts 144 and 146 held in openings 148 and 150, communicating with the cavities 38 and 40. Can 34 has a dispensing end part 152 with spout 153. Can 36 has a dispensing end part 154 with dispensing spout 155. The dispensing end parts of these cans are actuatable to dispense by being pushed inwardly by means of a plunger. The plungers are designated by the numerals 160 and 160'. Plunger 160 has a stem 161 that extends through a bore 162 in section 12 and on its end is a button 164 that is engageable with the operating end 152 of the cam 34. On the stem 161 is a coil spring 166 that acts on collar 168 and stem 161 normally biasing the plunger in an outward direction. On the stem 161 is a lug 170. The plunger can be pushed inwardly and turned so that this lip engages a lug on the inner wall of the bore 162 to hold the plunger in an inward set position. The plunger 160' illustrates this position of the plunger wherein it is held in an actuated position with the aerosol can being held in a position to dispense. The operation of the present embodiment is like that of the previous embodiments and will be readily understood by those skilled in the art. The difference is in the types of dispensing caps on the aerosol cans and the manual means for actuating the cans to dispense.

Figure 7:
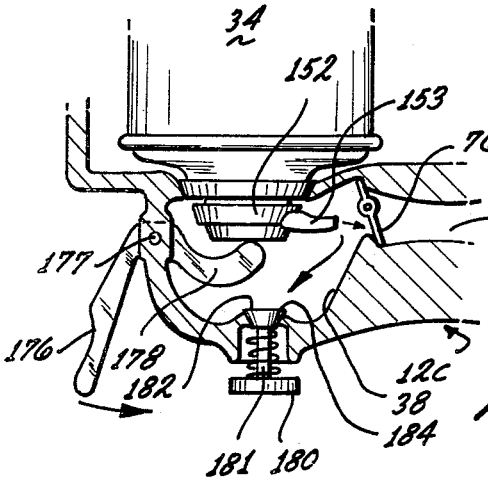
FIG. 7 is a partial sectional view of a further modified form of the invention.

FIG. 7 is a partial view showing a modified form of the invention showing a part of the bottom section **12*c*. The cam 34 like that of FIG. 6. Numeral 176 designates an actuating lever of bell crank shape, the lever being pivoted on a pivot stem 177 formed in a sidewall of the section 12*c*. The lever has a part 178 within the cavity 38 in a position to engage the operating cap end 152 of the can 34. This cam can be operated manually in a manner similar to that illustrated in FIG. 6. Numeral 180 designates a dispensing valve plunger having a stem 181 on the end of which is a valve 182 that cooperates with the valve seat 184 formed in the cottom of cavity 38. The operation of the form of the invention shown in FIG. 7** is like that of previous embodiments.

From the foregoing, those skilled in the art will readily understand the nature and construction of the invention and the manner in which it achieves and realizes all of the objectives as set forth in the foregoing.

The foregoing disclosure is representative of the preferred form of the invention and is to be interpreted in an illustrative rather than a limiting sense, the invention to be accorded the full scope of the claims appended hereto.

What is claimed is:

1. As an article of manufacture, means comprising a housing having in it a flow path for shower water and plurality of disposable dispensing type containers for additive for shower water, each of the containers having at one end a dispensing means including a stem actuatable by a lateral tilting movement thereof to dispense additive from the container, the housing having a wall part to which the containers are attached, selectively actuatable rotor means in said wall part for tilting said stem laterally and thereby causing the containers to dispense additive to channels including a channel providing communication to said flow path.

2. An article as defined in claim 1 wherein said stem extends into a cavity in said wall part adapted to receive and hold additive, and means for selectively providing communication from said cavity to said flow path.

3. An article as defined in claim 2 wherein said rotor comprises a cam engageable with a side of said dispensing means to tilt the same in said cavity.

4. An article as defined in claim 2 wherein said last-named means is separate from said rotor means.

5. An article as defined in claim 4 including further means separate from said last-named means for discharging additive from said cavity directly to the exterior of said housing.

* * * * *